US008066546B2

(12) United States Patent
Simpson

(10) Patent No.: US 8,066,546 B2
(45) Date of Patent: Nov. 29, 2011

(54) BRASSIERE

(75) Inventor: Elisabeth Simpson, Sai Kung (CN)

(73) Assignee: Triumph Intertrade AG, Bad Zurach (CH)

( * ) Notice: Subject to any disclaimer, the term of this patent is extended or adjusted under 35 U.S.C. 154(b) by 851 days.

(21) Appl. No.: 12/116,223

(22) Filed: May 7, 2008

(65) Prior Publication Data

US 2008/0280529 A1 Nov. 13, 2008

(30) Foreign Application Priority Data

May 7, 2007 (DE) ..... 20 2007 006 704 U

(51) Int. Cl.
*A41C 3/00* (2006.01)

(52) U.S. Cl. ..... 450/74; 450/75

(58) Field of Classification Search ..... 450/92, 450/93, 74–76, 71, 79
See application file for complete search history.

(56) References Cited

U.S. PATENT DOCUMENTS 6,645,040 B2 * 11/2003 Rabinowicz et al. ..... 450/1
6,860,789 B2 * 3/2005 Bell et al. ..... 450/20
7,144,294 B2 * 12/2006 Bell et al. ..... 450/20
7,407,427 B2 * 8/2008 Liu ..... 450/39
7,549,971 B2 * 6/2009 Bell et al. ..... 602/75
7,682,219 B2 * 3/2010 Falla ..... 450/92
2006/0105674 A1 * 5/2006 Lau ..... 450/39
2006/0281389 A1 * 12/2006 Liu ..... 450/1
2008/0280530 A1 * 11/2008 Simpson ..... 450/39
2008/0280533 A1 * 11/2008 Simpson ..... 450/39
2008/0280535 A1 * 11/2008 Simpson ..... 450/70
2009/0061732 A1 * 3/2009 Simpson ..... 450/41

* cited by examiner

*Primary Examiner* — Gloria Hale
(74) *Attorney, Agent, or Firm* — Muncy, Geissler, Olds & Lowe, PLLC

(57) ABSTRACT

A brassiere is provided with a front piece forming the breast cups and with two side pieces extending around the upper body of an individual, the first ends of which are fastened to the front piece and the second ends of which can be connected in the back area of the wearer. Each side pieces has a support piece forming an outline of the side pieces with an upper edge and a lower edge. On the outside of the side pieces an outer textile blank is provided, which is connected with the supporting element in the area of the upper edge and the lower edge. The outer textile blank is folded over twice with its edge, over the upper edge and the lower edge, wherein the first fold, travels directly along the upper or lower edge and the second fold travels between the support piece and the first fold.

16 Claims, 4 Drawing Sheets

BRASSIERE

This nonprovisional application claims priority under 35 U.S.C. §119(a) to German Patent Application No. 20 2007 006 704.6, which was filed in Germany on May 7, 2007, and which is herein incorporated by reference.

BACKGROUND OF THE INVENTION

1. Field of the Invention

The invention relates to a brassiere.

2. Description of the Background Art

Brassieres of this class are commonly known, and are available in a multitude of variations all over the world. They have a front section, which essentially comprises two bra cups, which come in a wide variety of different shapes, and which are joined together by a center strip. Connected to the respective outer lateral edges of the front section is a side panel, the free ends of which can be joined at the back of the person wearing the brassiere with a back closure. The side panels can be sewn to the front section, or they can be one piece. For additional support, shoulder straps can be provided, which connect the bra cups with the side panels in the rear. The essential function of such brassieres is bearing the weight, supporting, and shaping the bust. At the same time, such brassieres are expected to provide high wearing comfort and an appealing look.

Generally, brassieres of this class have support bands, piping, or trimming ribbons along their edges, which are most often attached with zigzag seams. In practical application, however, it was found that on the one hand, these seams can stand out against the outer wear, which has a negative effect on the overall appearance. On the other hand, these seams come in direct contact with the skin of the person wearing the brassiere, which can lead to skin irritation, especially with people having sensitive skin, thus impacting the wearing comfort in a negative way. This is particularly true for the seams in the area of the side panels because a well-fitting brassiere requires an appropriate tightness of the side panels, whereby the side panels are pressed against the upper body of the person wearing the brassiere.

SUMMARY OF THE INVENTION

In view of this background, it is an object of the invention to improve conventional brassieres with respect to their wearing comfort and their overall look.

The invention is based on the idea to provide concealed seams around the edges of a brassiere, that is, to cover the seams with a textile material. In this way, direct contact between the seams and the skin is avoided so that the wearing comfort is considerably improved and skin irritations are eliminated, even with sensitive skin. At the same time, by covering the seam, the seam itself becomes invisible, thus meeting the requirements of an appealing overall look.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
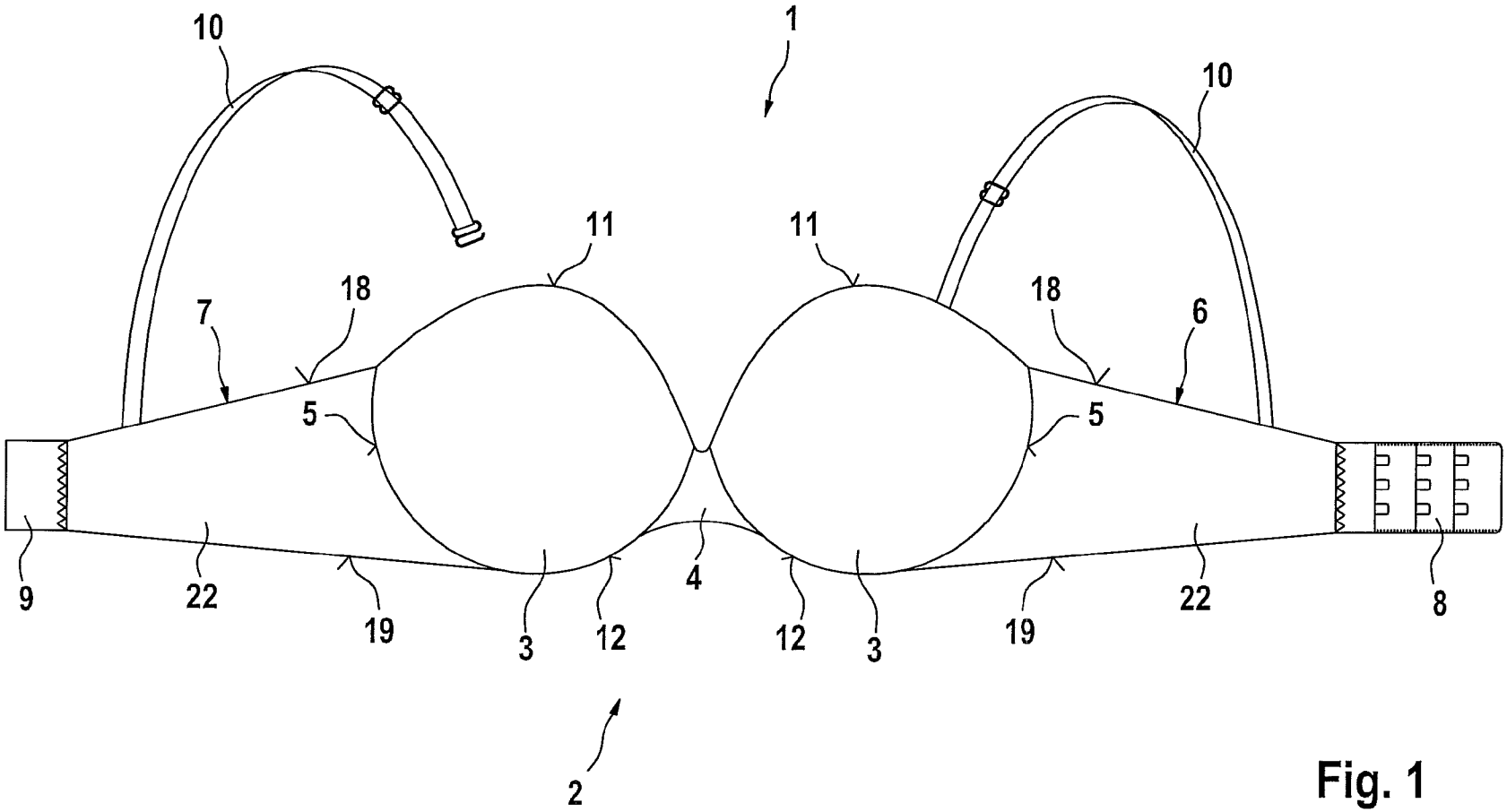
FIG. 1 is a front view of a brassiere of the present invention.

In FIG. 1, a brassiere of the present invention is illustrated in a front view. The brassiere 1 is comprised of a front section 2 having two bra cups 3 for accommodating the bust. The bra cups 3 can be formed of a rubber foam core, which is covered by a textile material, on the outside as well as the inside. The two bra cups 3 are joined together by center strip, which in the present embodiment is of trapezoidal shape.

Attached to the lateral edges 5 of the bra cups 3 is a respective side panel 6, 7, whereby at its free end, one side panel 6 has an eyelet tape 8, and the other side panel 7 is provided with a hook tape 9. The eyelet tape 8 and the hook tape 9 interact to form a back closure. In addition, there are two shoulder straps 10, which extend from the upper edge 11 of the bra cups 3 to the upper edge of the side panels 6, 7.

Figure 2B:
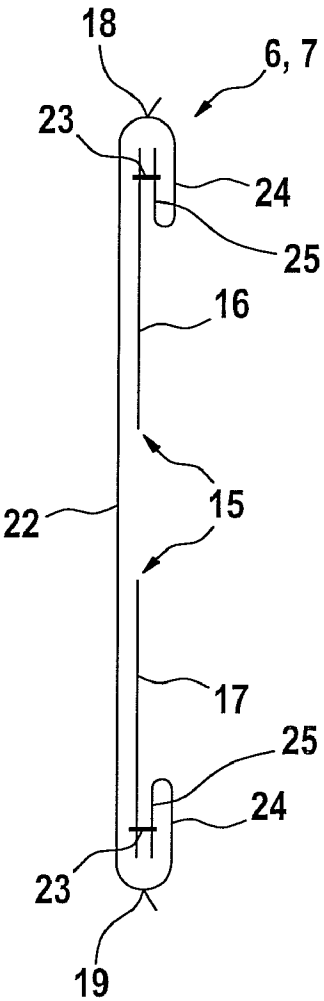
FIG. 2*b* is a cross section at a larger scale of the brassiere illustrated in FIG. 2*a* along line II-II therein.
Figure 2A:
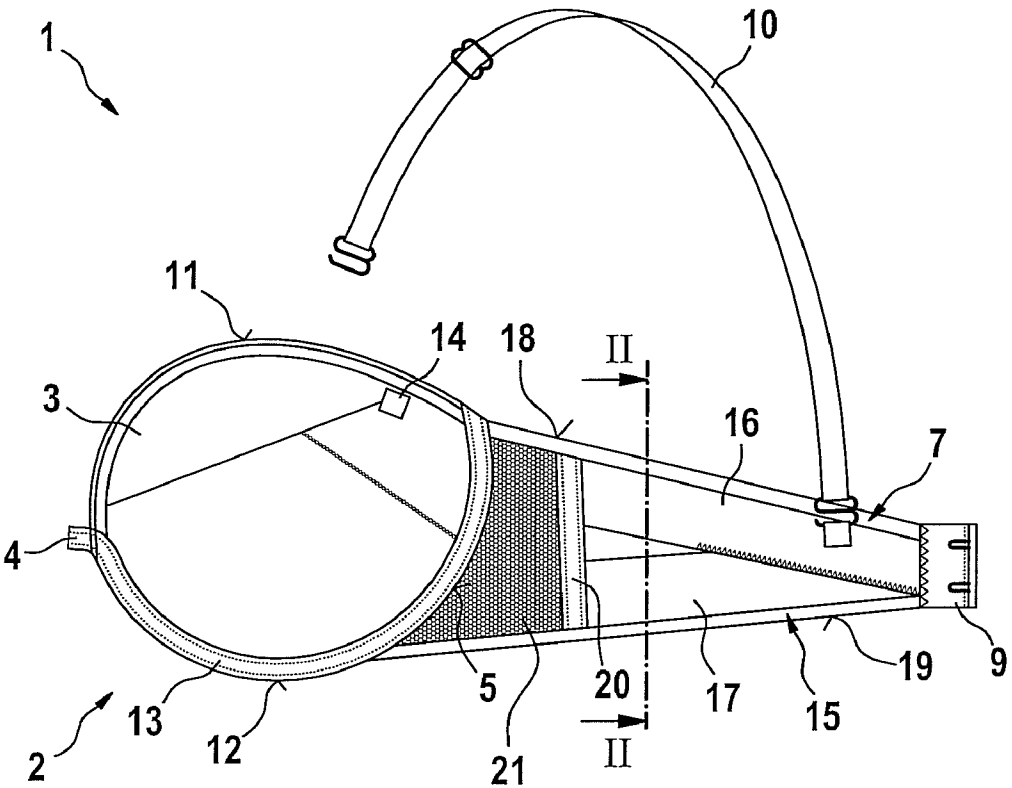
FIG. 2*a* is an inside view of one half of the brassiere illustrated in FIG. 1.

The detailed design of the brassiere 1, and in particular its side panels 6, 7, are described therebelow, using the illustrations in FIGS. 2*a* and 2*b* for reference. As is shown therein, underwires 13 are sewn into a suitably shaped pocket to reinforce the lower edge 12 of bra cup 3. The upper edge 11 of bra cup 3 is formed by folding over the outer fabric layer, which is sewn to the interior textile layer on the inside of bra cup 3. An attachment piece 14 for fastening the shoulder strap 10 can also be arranged there.

The essential part of each side panel 6, 7, is a support part 15, which in the instant embodiment is formed of an upper support band 16, and a lower support band 17, but could also be a one-piece blank. Separating it into two support bands 16 and 17 provides a definite force progression. To improve the wearing comfort, the support bands 16 and 17 are elastic in a longitudinal direction.

In the area of the eyelet tape 8 and/or the hook tape 9, the two support bands 16 and 17 overlap, and diverge towards the upper, that is, the lower lateral edge 5 of the bra cups 3, to which they are firmly attached. In the overlapping area of the support bands 16 and 17, they are sewn together in order to strengthen the overall form stability of support part 15. In this way, a roughly triangular-shaped contour line of the side panels 6, 7, is achieved, whereby the upper support band 16 forms the upper edge 18 of the side panel 6, 7, and the lower support band 17 forms the lower edge 19 thereof.

In the longitudinal section to support bands 16 and 17 facing the bra cup 3, there is also a reinforcement element 20, which extends from the upper edge 18 to the lower edge 19, thus keeping the two edges 18 and 19 at a distance. The reinforcement element 20 is formed by a textile pocket, which accommodates a rigid plastic rod.

The area enclosed by the reinforcement element 20, the two edges 18 and 19 as well as the lateral edge 5 of the bra cup 3 is reinforced by an additional woven blank 15, which along its edges is sewn to the lateral edge 5 of bra cup 3, the reinforcement element 20 as well as the upper and lower edge 18, 19, of side panel 6, 7. Thus, an even distribution of the force transmission from the front section 2 into the side panels 6, 7, is achieved.

The exterior side of each side panel 6, 7, is formed by an exterior textile blank 22, which is folded twice over the upper and lower edge 18, 19 of side panels 6, 7, and there, along the edges 18, 19, is sewn to the support bands 16 and 17. The exterior textile blank 22 has elastic properties, both in a longitudinal and in a transverse direction, to ensure a wrinkle-free look.

Figure 4:
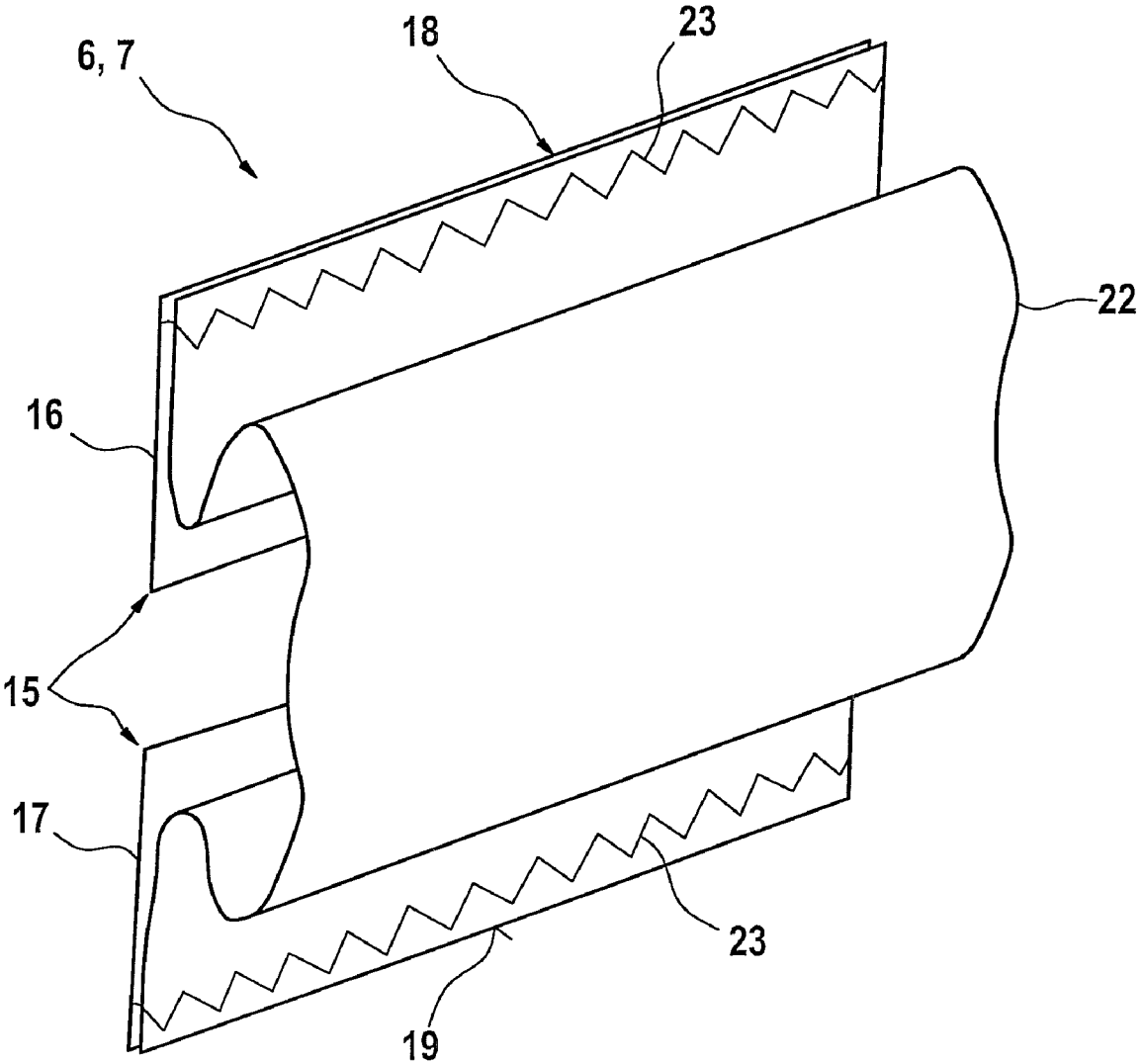
FIG. 4 is a side view of a section of a not yet finished side panel of the present invention.

In order to make these seams 23 as inconspicuous as possible with respect to wearing comfort and the overall look of a brassiere 1, concealed seams 23 are applied. For this purpose, the exterior textile blank 22 is congruently placed with its longitudinal edges along the upper edge 18 and/or the lower edge 19 on top of the side panels 6, 7, and is attached to the support bands 16 and 17 by seams 23, as illustrated in FIG. 4. In this state, the future exterior side of the outer textile blank 22 and the future inner side of the support part 15 are positioned opposite each other.

Subsequently, by turning the side panel 6, 7 inside out, the outer textile blank 22 is repositioned to the exterior side of side panel 6, 7. The state achieved in this way is illustrated in FIG. 2*b*. As a result of the turning process, a twice-folded edge of the outer textile blank 22 is generated in the area of the upper edge 18 and the lower edge 19. The first foldover 24 envelopes thereby the upper edge 18 and/or the lower edge 19. The second foldover 25 is folded over in the area between the support bands 16, 17, and the first foldover 24, whereby the free edge of the second foldover 25 points in the direction of edges 18, 19. The purpose of the second foldover 25 is to attach the outer textile blank 22 to the support bands 16 and 17 by seams 23, which are covered by the first foldover 24 after being turned inside out, thus becoming invisible. At the same time, the skin is protected from direct contact with seams 23.

In order to minimize bulk in the area of the seams 23 of the side panels 6, 7, the seams 23 are executed as flat seams, preferably with zigzag stitches. Alternatives within the scope of the invention are thermal fusion seams, ultrasonic welding seams, or adhesive bonding.

Figure 3B:
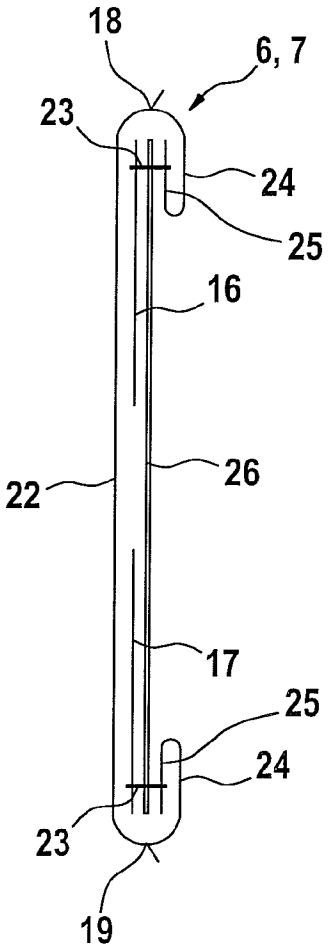
FIG. 3*b* is a cross section at a larger scale of the brassiere illustrated in FIG. 3*a* along line III-III therein.
Figure 3A:
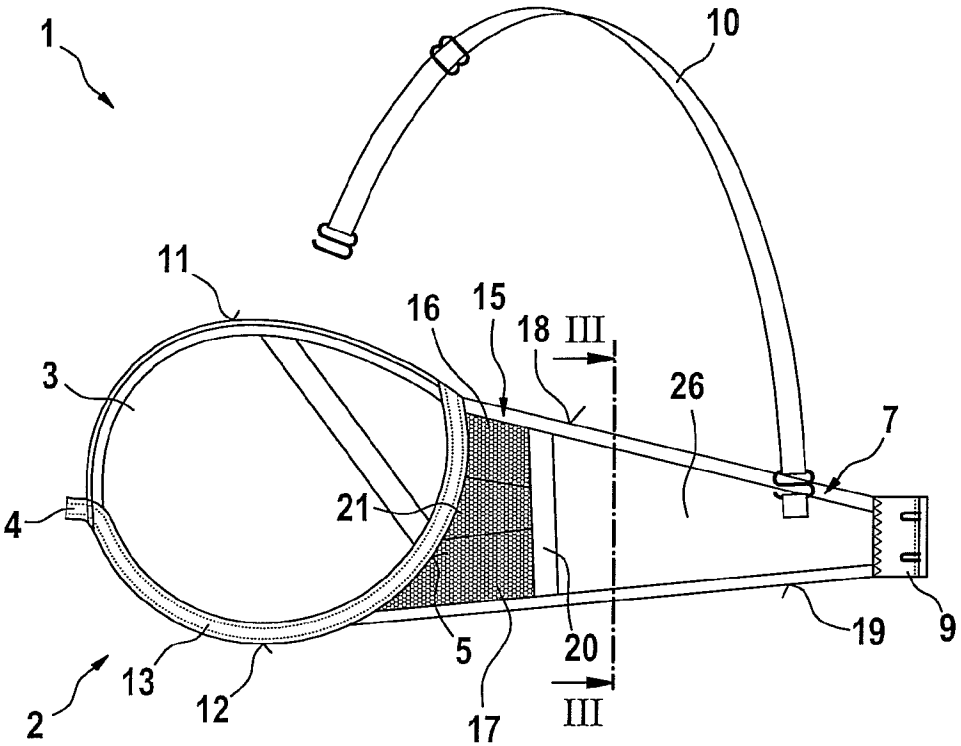
FIG. 3*a* is an inside view of a second embodiment of a brassiere of the present invention.

The brassiere 1 shown in FIGS. 3*a* and *b* corresponds for the most part with the embodiment described in FIGS. 1, 2*a* and 2*b* so that the same reference numerals are used for the same features and elements, and the corresponding description applies.

The essential feature that is different from the previously described embodiment is that in addition, the side panels 6, 7 are complemented by an interior textile blank 26. The purpose of the inner textile blank 26 is to cover the support bands 16 and 17 on the inner side of the of the side panels 5, 6, and is attached to the side panels 6, 7, during the application of the seams 23. For this purpose, the inner textile blank 26 is attached by the seams 23 between the support bands 16, 17, and the second foldover 25 of the outer textile blank 22. By subsequently turning the side panel 6, 7, inside out, the outer textile blank 22 is likewise turned to the outer side of the side panel 6, 7, whereas the inner textile blank 26 remains on the inner side covering the support bands 16 and 17.

The invention is not limited to the side panels 6, 7, of brassiere 1 but is equally suitable for applying invisible, thus optically appealing and comfortable seams in the area of bra cups 3. For example, in this way, the outer layer of bra cup 3 can be folded twice over its upper edge 11 and sewn there to the inner layer of bra cup 3, in accordance with previously described procedures for side panels 6, 7. Furthermore, the term "brassiere" comprises all women's intimate apparel with built-in bust support, including bikini tops and swimsuits.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed:

1. A brassiere comprising:

a front section forming bra cups;

two side panels configured to encircle an upper body of a person wearing the brassiere, first ends of which are laterally attached to the front section, and second ends of which are configured to be joined together on a back of the person, the side panels respectively include a support part, which shapes a contour of the side panels, having an upper edge and a lower edge; and an outer textile blank provided on an exterior side of the side panels, which in the area of the upper edge and the lower edge is attached to the support element, wherein the textile blank on an edge is folded twice over the upper edge and/or the lower edge, respectively, wherein the first foldover, with inclusion of the support part, extends directly along the upper and/or the lower edge, and the second foldover extends between the support part and the first foldover, and wherein a free edge of the second foldover faces the upper edge and/or the lower edge, and only the second foldover and the support part are joined together by seams.

2. The brassiere according to claim 1, wherein the support part is formed of an upper support band and a lower support band.

3. The brassiere according to claim 2, wherein the support bands are attached to one another at the free end of the side panel and extend in diverging directions toward the front section.

4. The brassiere according to claim 2, wherein the upper support band and the lower support band form an overlapping area and are, at least in this area, joined together.

5. The brassiere according to claim 1, further comprising an interior textile blank, which is attached between the second foldover and the support part by seams.

6. The brassiere according to claim 1, wherein, in an area of the side panels aligned with the bra cup, a rod-shaped reinforcement element, which extends from the upper edge to the lower edge of the side panels, is respectively arranged.

7. The brassiere according to claim 6, wherein the reinforcement element is attached at ends thereof to the side panel by seams.

8. The brassiere according to claim 1, wherein, in an area of the side panels adjoining the bra cups, a non-elastic woven blank is arranged.

9. The brassiere according to claim 1, wherein, in a direction of the longitudinal extension of the side panels, the support part is elastic.

10. The brassiere according to claim 1, wherein the exterior textile blank is elastic, both in a longitudinal and in a transverse direction.

11. The brassiere according to claim 1, wherein the first foldover and the second foldover are fashioned by an inside-out turning process.

12. The brassiere according to claim 1, wherein the seams are flat seams.

13. The brassiere according to claim 1, wherein the seams are fashioned by sewing, thermal fusing, ultrasonic welding, or by adhesive bonding.

14. The brassiere according to claim 1, wherein the brassiere is part of a bikini or a swimsuit.

15. The brassiere according to claim 4, wherein said upper band and said lower support band are joined together by being sewn together.

16. The brassiere according to claim 12, wherein said seams are zigzag seams.

* * * * *

UNITED STATES PATENT AND TRADEMARK OFFICE

CERTIFICATE OF CORRECTION

PATENT NO. : 8,066,546 B2
APPLICATION NO. : 12/116223
DATED : November 29, 2011
INVENTOR(S) : Simpson It is certified that error appears in the above-identified patent and that said Letters Patent is hereby corrected as shown below:

Title Page;

Change from:

(73) Assignee: Triumph Intertrade AG, Bad Zurach (CH)

To:

(73) Assignee: Triumph Intertrade AG, Bad Zurzach (CH)

Signed and Sealed this
Eighteenth Day of September, 2012

David J. Kappos

David J. Kappos
*Director of the United States Patent and Trademark Office*